US005494082A

United States Patent [19]

Rathenberg

[11] Patent Number: 5,494,082

[45] Date of Patent: Feb. 27, 1996

[54] PLASTIC FILLER INSERT FOR A WRITING FLUID CONVERTER

[75] Inventor: Jürgen Rathenberg, Bad Gandersheim, Germany

[73] Assignee: rotring-werke Riepe KG, Hamburg, Germany

[21] Appl. No.: 300,128

[22] Filed: Sep. 2, 1994

Related U.S. Application Data

[62] Division of Ser. No. 195,813, Jan. 27, 1994, Pat. No. 5,406,991, which is a continuation of Ser. No. 937,307, Aug. 31, 1992, abandoned.

[30] Foreign Application Priority Data

Aug. 31, 1991 [DE] Germany ..... 91 10 826.8
Oct. 23, 1991 [DE] Germany ..... 91 14 416.7

[51] Int. Cl.[6] ..... B65B 1/04; B65B 3/04

[52] U.S. Cl. ..... 141/18; 141/21; 141/25; 215/11.2

[58] Field of Search ..... 141/20.5, 21–28, 141/18, 3; 215/11 A; 220/705, 707, 709; 401/123, 131

[56] References Cited

U.S. PATENT DOCUMENTS

| | | | |
|---|---|---|---|
| 224,577 | 2/1880 | Potter | 215/11.1 |
| 1,854,814 | 4/1932 | Terry | 141/20.5 X |
| 1,875,866 | 9/1932 | Harris et al. . | |
| 2,554,658 | 5/1951 | Bolsey | 141/20.5 |
| 2,874,732 | 2/1959 | Zepelovitch | 141/20.5 |
| 2,938,499 | 5/1960 | Lindenbaum | 141/20.5 |
| 4,607,755 | 8/1986 | Andreozzi . | |
| 4,695,176 | 9/1987 | Simonette et al. | 141/20.5 |

FOREIGN PATENT DOCUMENTS

| | | | |
|---|---|---|---|
| 0210469 | 2/1987 | European Pat. Off. . | |
| 86121715 | 12/1986 | Germany . | |
| 424051 | 8/1947 | Italy | 141/20.5 |
| 255993 | 5/1947 | Switzerland | 141/20.5 |
| 534132 | 2/1941 | United Kingdom . | |
| 1175582 | 12/1969 | United Kingdom | 200/709 |

*Primary Examiner*—Henry J. Recla
*Assistant Examiner*—Steven O. Douglas
*Attorney, Agent, or Firm*—Fitzpatrick, Cella, Harper & Scinto

[57] ABSTRACT

A plastic filler insert for use with (i) a writing instrument having a converter device including (a) a piston-cylinder unit adapted to receive and dispense writing fluid and (b) an aspirating connector, and (ii) a writing fluid container (1) having a cylindrical neck opening (2), which can be closed off with a cap. The filler insert permits refilling, from the container, of the writing instrument. The filler insert includes a closure plate (3) having a sealing edge (4). The sealing edge (4) is configured to be seated on a rim of the cylindrical neck opening (2) of the writing fluid container (1). The closure plate includes a receiving connector (6) formed on the bottom (5) of the closure plate (3). The receiving connector (6) has a cylindrical receiving opening (7), is open toward the outside, and extends into the interior of the container (1). The receiving connector (6) includes an aspirating hose (9) configured to extend through the interior of the container toward a bottom surface thereof, when the aspirating connector of the converter device has been inserted sealingly into the cylindrical receiving opening (7) of the receiving connector (6).

3 Claims, 3 Drawing Sheets

PLASTIC FILLER INSERT FOR A WRITING FLUID CONVERTER

This application is a division of application Ser. No. 08/195,813, now U.S. Pat No. 5,406,991, filed Jan. 27, 1994, which is a continuation of application Ser. No. 07/937,307, filed Aug. 31, 1992, now abandoned.

BACKGROUND OF THE INVENTION

1. Field of the Invention

The invention first relates to a plastic filler insert for a writing fluid container, having a cylindrical neck opening which can be closed off with a cap. Writing instruments are refilled from a container which has a converter device consisting of a piston-cylinder unit for receiving and dispensing writing fluid.

The invention secondly relates to a device for filling a converter containing a writing fluid. The converter has an orifice in the shape of the orifice of a conventional ink cartridge, with a reservoir containing a writing fluid.

2. Brief Description of the Prior Art

In place of writing fluid cartridges, in particular ink cartridges, converters are employed to a great extent in writing instruments, for example fountain pens, which were originally embodied to use writing fluid cartridges. While the writing fluid cartridges are thrown away when empty, the converter permits refilling by means of a piston mechanism contained in it. More specifically, such converter devices consist of a piston-cylinder unit, by means of which writing fluid for filling the writing instrument is aspirated from a container.

Up to now, grave disadvantages arise if writing fluid containers with screw tops were used for filling converters and the orifice of the converter was dipped into the writing fluid contained in the writing fluid container and writing fluid is aspirated by means of the aspirating connector of the converter device (German Utility Model DE-GM 86 12 171). In normal use it is almost impossible in the course of refilling to dip the aspirating connector into the writing fluid with sufficient care so that soiling of at least the aspirating connector with writing fluid can be avoided, so that the user is required to clean it prior to inserting it into the writing instrument. Moreover, it is almost impossible to avoid aspirating air together with the writing fluid. If this air remains in the converter device, the writing fluid is dispensed unevenly, which interferes with the writing process.

OBJECTS AND SUMMARY OF THE INVENTION

For assured avoidance of these disadvantages, one object of the invention is to provide a special component which is simple to produce and by means of which every writing fluid container can be complemented in a simple manner. Secondly, the invention provides a device by means of which a converter can be filled in a simple manner and without becoming soiled.

The first object is attained in accordance with the invention by means of a plastic filler insert for a writing fluid container with a cylindrical neck opening which can be closed off with a cap, in that this filler insert is embodied in the form of a closure plate having a sealing edge seated on the rim of the neck opening of the container. A receiving connector, which is open toward the outside and is pointed into the interior of the container is formed on the bottom of the plate, which is continued in the interior as an aspirating hose extending toward the container bottom. The aspirating connector of the converter device can be sealingly inserted into its cylindrical receiver opening. Such a closure plate can be easily formed from plastic. Resilient plastics in particular, and also synthetic rubber materials, are intended to be this plastic. This closure plate is inserted into the container opening in the manner of a closure plug. Its sealing edge rests on the rim of the neck opening and the required tight sealing of the container in the course of placing or screwing the closure cap on the container is achieved in this way.

The main advantage achieved by means of the receiving connector is that the aspirating connector of the converter device of a writing instrument can be inserted simply, securely and especially sealingly into the receiving connector after the closure cap has been removed. Subsequently, writing fluid can be aspirated from the container into the converter device in an exactly defined and sealed position. In this way the aspirating connector of the converter has no contact with writing fluid in the container, except for the defined opening of the aspirating hose. Soiling of the aspirating connector and thus of the converter as well as the writing instrument itself, and the aspiration of air is completely prevented.

The bottom of the receiving connector also securely seals the connecting surface of the aspirating connector of the converter. Therefore, the entire filling operation can be performed simply, safely and without danger of soiling, as well as without danger of aspirating air. The closure plate and the aspirating connector with the aspirating hose can be produced of one piece of a suitable plastic.

A suitable small opening can be provided in the closure plate for letting air into the interior of the container during removal of the writing fluid.

In order to be able to continue to fill other writing instruments without converter devices and without having to remove the closure plate of the filler insert, it is practical in accordance with another embodiment of the invention to provide a through-opening in the bottom of the closure plate outside of the receiving connector, which can be closed by means of an associated insertable closure element. The size of the through-opening can be selected to be such that conventional writing instruments can be inserted for refilling. This through-opening can be securely closed by means of the insertable closure element, which can be made from the same plastic. In this connection it is advantageous to provide a gripping tab or the like on the edge of the closure element, which remains at the top inside the area of the closure plate. It is advantageous here to embody the closure element for the through-opening also in the shape of a plate-shaped closure plug, having a sealing edge placed on the outside of the closure plate bottom in such a way that the sealing edge remains inside the closure plate. Producing such a part is simple, it is safely maintained in the through-opening and the removal of this closure plug is simple.

An exemplary embodiment of this aspect of the invention, namely a filler insert for a so-called ink bottle, is illustrated in FIGS. 1 and 2.

A second object of the invention is a device for filling a converter that is embodied in accordance with the invention in such a way that the reservoir has a connector adapted for a for sealing placement with the orifice of a converter. Furthermore, in the interior of the reservoir a pipe-shaped conduit segment extends from the connector as far as the bottom of the reservoir.

With a device in accordance with the invention, the converter can be sealingly connected with the reservoir, so that writing fluid transported from the reservoir into the converter cannot soil the outside of the converter. In addition, the writing fluid for the converter is taken out of the reservoir via a pipe-shaped conduit segment, which extends close to the bottom of the reservoir, so that it is not necessary to turn the reservoir over. Normally this would pose the danger of leakage of writing fluid from the reservoir.

The inner end of the conduit segment lies close to the bottom, so that all writing fluid can be taken from the reservoir. Furthermore, to prevent the inner opening of the conduit segment from coming to rest on the bottom of the reservoir, and thereby shutting off the flow of the writing fluid, the conduit segment preferably extends coaxially with the connector, in the area adjoining the connector. A conduit segment may also continue downwardly in the interior of the reservoir, with a free end that rests on the bottom of the reservoir and is inclined in relation to the bottom. In this way a sealing connection is assuredly not formed between the bottom and the inner opening of the conduit segment.

To prevent underpressure from being created in the reservoir when aspirating writing fluid out of it and into the converter, which would hamper this aspiration of writing fluid, the reservoir also preferably has an opening adjacent to the connector.

A pipe-shaped conduit segment also preferably forms a capillary conduit, so that the writing fluid in the conduit segment is always kept close to the connector when the level of writing fluid in the reservoir is lowered.

A converter-filling device in accordance with this second object will be described in more detail below, and with reference to FIGS. 3 and 4 illustrating an exemplary embodiment thereof.

DETAILED DESCRIPTION OF THE PREFERRED EMBODIMENTS

Figure 1:
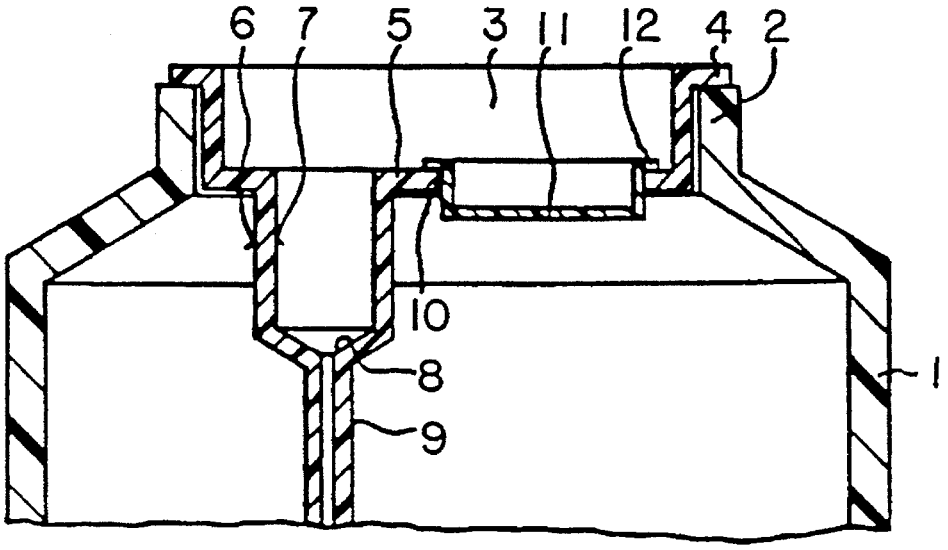
FIG. 1 is a sectional view of the closure element in accordance with the invention, shown within the neck opening of a container, of which only the upper portion is shown for the sake of simplicity.
Figure 2:
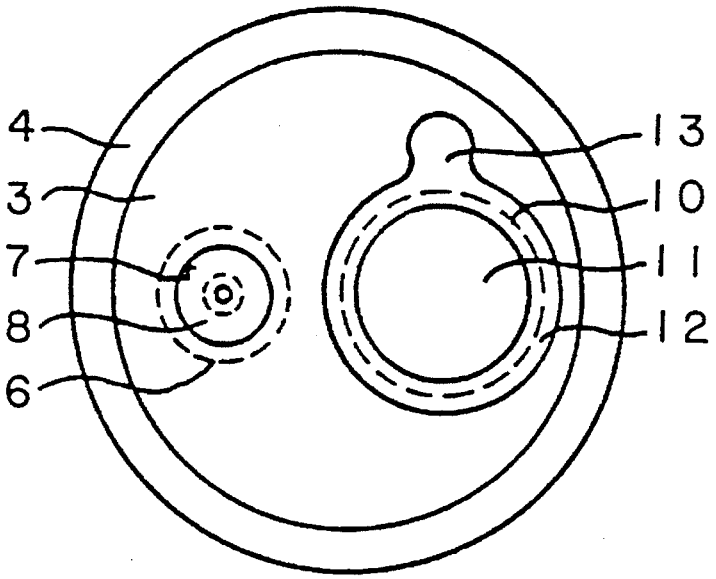
FIG. 2 is a top view of a filler insert in accordance with FIG. 1.

The first object of the invention will now described according to the preferred embodiment, of FIGS. 1 and 2. The upper portion of a writing fluid container 1, for example an ink bottle, is schematically shown in FIG. 1. The container 1 is closed by means of a suitable dosing cap, for example a screw cap, on the upper cylindrical neck opening 2.

The filler insert is formed of plastic as a closure plate 3 and has a sealing edge 4 seated on the edge of the neck opening. A receiving connector 6, open to the outside and directed toward the interior of the container, is formed in its bottom 5. In this way the connector 6 has a cylindrical receiving opening 7, which terminates on the bottom and on the inside in a cone-shaped bottom surface 8. The receiving connector 6 continues on to form an aspirating hose 9 extending to the bottom of the container.

After removal of the closure cap, not shown in FIG. 1, from the container neck 2, the aspirating connector of a converter device of a writing instrument can be inserted into the cylindrical receiving opening 7 of the receiving connector 6. It is then possible to aspirate writing fluid from the container via the aspirating hose 9 by means of the piston-cylinder unit of the converter.

A through-opening 10 is provided in the bottom 5 of the closure plate 3 outside of the receiving connector 6. As shown in particular in FIG. 2, the receiving opening 7 of the receiving connector 6 is in this case disposed off-centered. Because of this it is possible to give the through-opening 10 sufficient width, so that the writing points of other writing instruments can be freely inserted into the interior of the container, and such writing instruments can be refilled without the aspirating connector 6. It is possible to give the contour of the through-opening 10 a shape suitable for the respective intended use. The through-opening 10 can be closed by means of an associated insertable closing element 11.

In accordance with FIG. 1, a closing plate is embodied as a plate-shaped closure plug with a sealing edge 12 resting on the closure plate bottom 5 in such a way that the sealing edge remains inside the closure plate. In a practical manner and in accordance with FIG. 2, the sealing edge 12 is formed into a gripping tab 13 to make manipulation easier.

Plastic materials are chosen to be suitable for the respective intended use. Easily resilient plastics will be employed for the closure plate 3 and the closure plug 11. The closure plate 3 and the closure plug 11 with the gripping tab 13 are made from the same plastic material.

In accordance with a second embodiment of the invention, the closure element for a through-opening 10 in a closure plate bottom 5 can be pivotably formed via a resilient bridge of plastic upon a section of its periphery that is on the bottom of the closure plate. In this case, the closure element cannot be lost and represents a common component with the closure plate.

Figure 3:
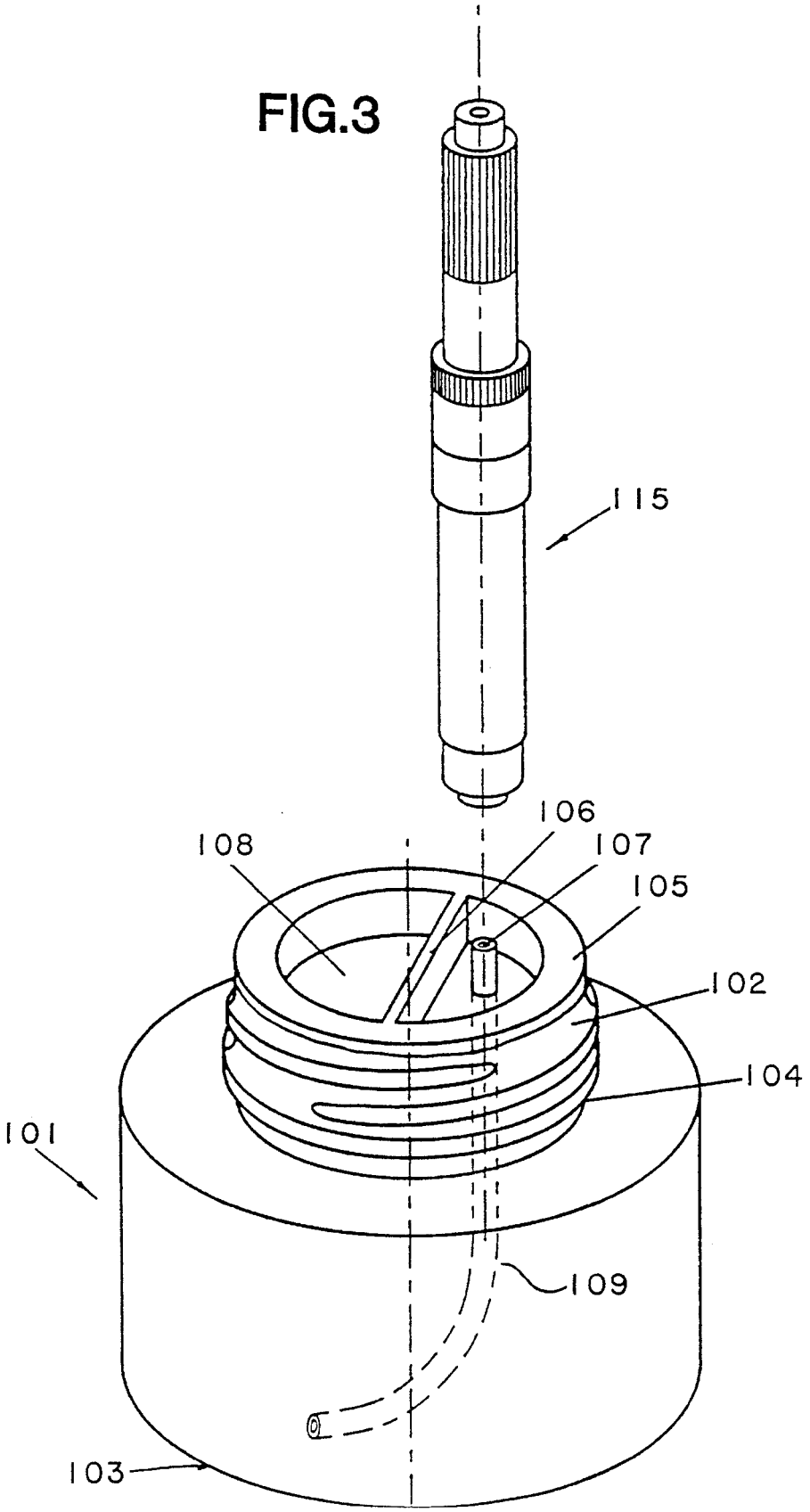
FIG. 3 is a perspective view of a reservoir with the converter placed above the reservoir in accordance with the invention.
Figure 4:
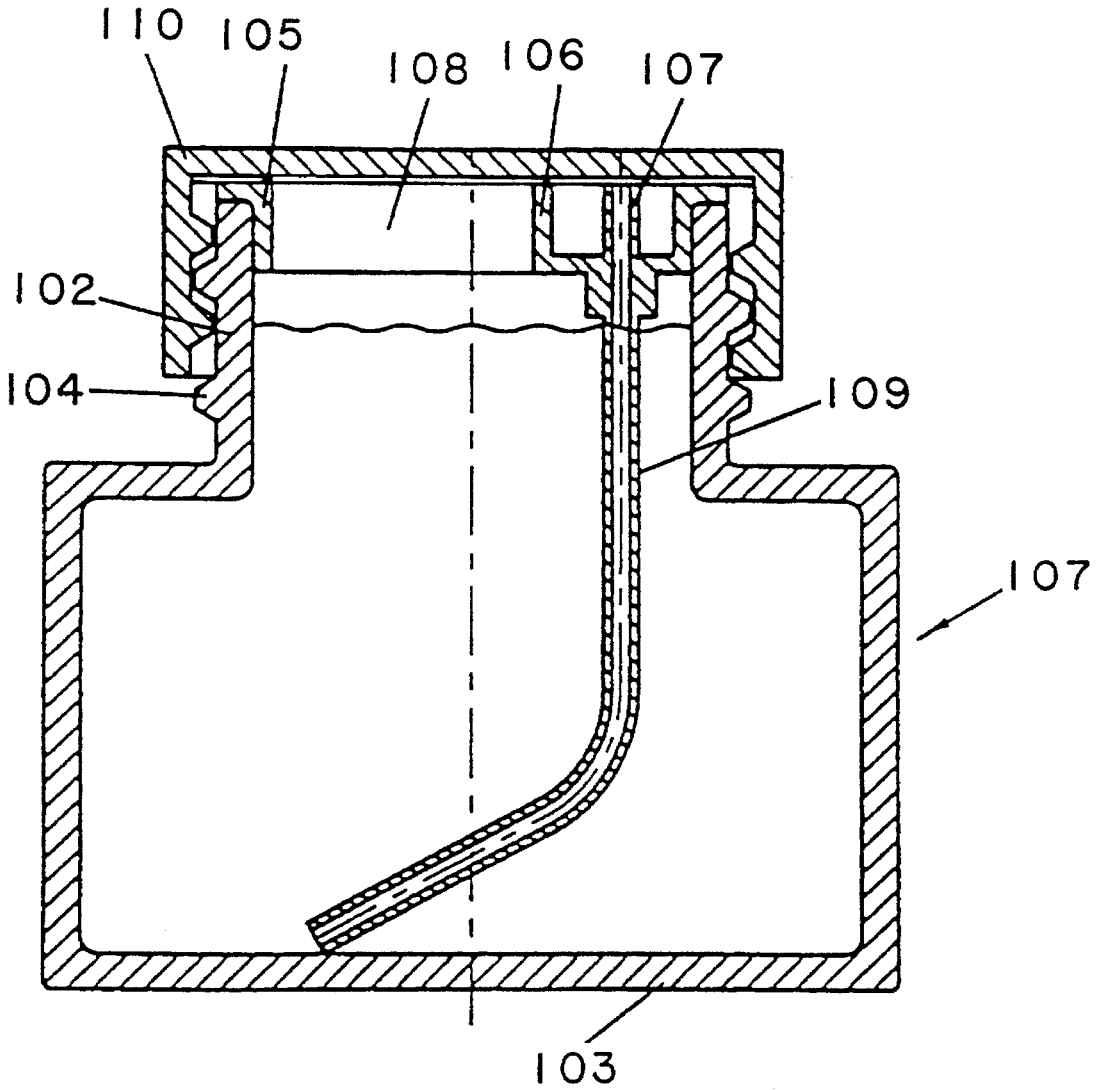
FIG. 4 is a sectional view through the reservoir of FIG. 3, closed by a screw cap.

The second object of the invention will now described according to the preferred embodiment shown in FIGS. 3 and 4. The reservoir 101 shown in FIG. 3 has a bottom 103 and a neck area 102, on the outside of which a thread 104 has been cut. As seen in FIG. 4, a closure cap 110 also can be screwed on the neck.

An insert 105 has been dampingly placed in the neck area 102. A through-opening 108 is located on one side of it, while a wall adjoins the other side, which extends as far as the peripheral wall of the insert 105. A connector 107 extends upwardly through it. The central opening of the connector 107 extends through the wall. A conduit segment 109, perhaps in the shape of a hose, is fastened on the underside of the connector 107. The upper area of the conduit segment 109 extends coaxially with the central axis of the connector 107. In its lower area it is obliquely disposed, so that its lower end rests slantingly on the bottom 103. Because of this, the opening provided on the lower end of the conduit segment 109 is always located above the bottom 103. Preferably the conduit segment 109 forms a capillary conduit, in which the writing fluid always is close to the connector 107.

The exterior shape of the connector 107 has been selected to be such that it can be sealingly placed on a converter 115 with its opening. The converter customarily has an orifice which is embodied corresponding to the orifice of a so-called Euro ink cartridge.

To fill the converter 115, the screw cap 110 is removed from the reservoir 101, and the converter 115, with its piston moved into the front position, is placed on the connector 107. Writing fluid, customarily ink, is aspirated into the converter 115 via the conduit segment 109. The creation of underpressure in the reservoir 101 in the course of this is prevented by the opening 108 in the insert 105 of the reservoir 101. Because the conduit segment 109 extends proximate to the bottom 103, it is assured that the reservoir 101 can be practically completely emptied via the conduit segment 109.

It should be mentioned ,of course, that it also is possible to fill a fountain pen through the opening 108. Thus, the reservoir 101 can be used additionally as a customary ink bottle. However, the opening 108 also may be closed off by means of a semi-permeable membrane, which is permeable to air and impermeable to fluid.

While the present invention has been described with respect to what presently are considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

We claim:

1. A plastic filler insert for use with (i) a writing instrument having a converter device including (a) a piston-cylinder unit adapted to receive and dispense writing fluid and (b) an aspirating connector, and (ii) a writing fluid container (1) having a cylindrical neck opening (2), which can be closed off with a cap, said filler insert permitting refilling, from the container (1), of the writing instrument, said filler insert comprising:

a closure plate (3) having a sealing edge (4), the sealing edge (4) being configured to be seated on a rim of the cylindrical neck opening (2) of the writing fluid container (1), said closure plate (3) comprising a receiving connector (6), formed on a bottom (5) of the closure plate (3), said receiving connector (6) having a cylindrical receiving opening (7), and being open toward the outside, and extending into the interior of the container (1), said receiving connector (6) comprising an aspirating hose (9) configured to extend through the interior of the container (1) toward a bottom surface thereof, when the aspirating connector of the converter device has been inserted sealingly into the cylindrical receiving opening (7) of said receiving connector (6); and wherein said closure plate (3) has a through-opening (10) configured to allow filling of writing instruments, said through-opening (10) being provided in the bottom (5) of said closure plate (3) outside of said receiving connector (6), said through-opening (10) being configured to be closed by means of an associated insertable closure element (11).

2. A plastic filler insert for use with (i) a writing instrument having a converter device including (a) a piston-cylinder unit adapted to receive and dispense writing fluid and (b) an aspirating connector, and (ii) a writing fluid container (1) having a cylindrical neck opening (2), which can be closed off with a cap, said filler insert permitting refilling, from the container (1), of the writing instrument, said filler insert comprising:

a closure plate (3) having a sealing edge (4), the sealing edge (4) being configured to be seated on a rim of the cylindrical neck opening (2) of the writing fluid container (1), said closure plate (3) comprising a receiving connector (6), formed on a bottom (5) of the closure plate (3), said receiving connector (6) having a cylindrical receiving opening (7), and being open toward the outside, and extending into the interior of the container (1), said receiving connector (6) comprising an aspirating hose (9) configured to extend through the interior of the container (1) toward a bottom surface thereof, when the aspirating connector of the converter device has been inserted sealingly into the cylindrical receiving opening (7) of said receiving connector (6), wherein said closure plate (3) has a through-opening (10) provided in the bottom (5) of said closure plate (3) outside of the receiving connector (6), said through-opening (10) being configured to be closed by means of an associated insertable closure element (11), wherein the closure element (11) for the through-opening (10) comprises a plate-shaped closure plug (11), having a sealing edge (12) placed on the outside of the bottom (5) of the closure plate (3) so that the sealing edge remains inside the closure plate (3).

3. A plastic filler insert for use with (i) a writing instrument having a converter device including (a) a piston-cylinder unit adapted to receive and dispense writing fluid and (b) an aspirating connector, and (ii) a writing fluid container (1) having a cylindrical neck opening (2), Which can be closed off with a cap, said filler insert permitting refilling, from the container of the writing instrument, said filler insert comprising:.

a closure plate (3) having a sealing edge (4), the sealing edge (4) being configured to be seated on a rim of the cylindrical neck opening (2) of the writing fluid container (1), said closure plate (3) comprising a receiving connector (6), formed on a bottom (5) of the closure plate (3), said receiving connector (6) having a. cylindrical receiving opening (7), and being open toward the outside, and extending into the interior of the container (1), said receiving connector (6) comprising an aspirating hose (9) configured to extend through the interior of the container (1) toward a bottom surface thereof, when the aspirating connector of the converter device has been inserted sealingly into the cylindrical receiving opening (7) of said receiving connector (6), wherein said closure plate (3) has a through-opening (10) provided in the bottom (5) of said closure plate (3) outside of the receiving connector (6), said through-opening (10) being configured to be closed by means of an associated insertable closure element (11), wherein the closure element (11) comprises a resilient bridge of plastic integrally formed with said closure plate (3), said closure element (11) being pivotally attached on a section of its periphery on the bottom (5) of the closure plate (3).

* * * * *